US006800118B2

(12) United States Patent
Kusunose et al.

(10) Patent No.: US 6,800,118 B2
(45) Date of Patent: Oct. 5, 2004

(54) GAS/LIQUID SEPARATION DEVICES

(75) Inventors: Ryo Kusunose, Okayama-ken (JP); Takushi Yokota, Kurashiki (JP); Kojiro Nishi, Niihama (JP)

(73) Assignee: Gore Enterprise Holdings, Inc., Newark, DE (US)

( * ) Notice: Subject to any disclaimer, the term of this patent is extended or adjusted under 35 U.S.C. 154(b) by 0 days.

(21) Appl. No.: 10/190,989

(22) Filed: Jul. 8, 2002

(65) Prior Publication Data

US 2003/0051451 A1 Mar. 20, 2003

(51) Int. Cl.[7] ..... B01D 53/22
(52) U.S. Cl. ..... 96/5; 95/44; 261/152
(58) Field of Search ..... 96/5; 95/44, 159, 95/263; 261/152, 153, 154, 155

(56) References Cited

U.S. PATENT DOCUMENTS

| | | | | |
|---|---|---|---|---|
| 3,962,153 A | | 6/1976 | Gore | 260/2.5 R |
| 4,902,423 A | | 2/1990 | Bacino | 210/500.36 |
| 5,482,859 A | * | 1/1996 | Biller et al. | 435/266 |

FOREIGN PATENT DOCUMENTS

| | | |
|---|---|---|
| JP | 46-7284 | 12/1971 |
| JP | 50-22881 | 3/1975 |
| JP | 3-504876 | 8/1990 |
| JP | 5-286039 | 11/1993 |
| JP | 7-4701 | 1/1995 |
| JP | 8-128682 | 5/1996 |
| JP | 2000-274754 | 10/2000 |
| WO | WO 94/22928 | 10/1994 |
| WO | WO 95/34583 | 12/1995 |

* cited by examiner

*Primary Examiner*—Robert A. Hopkins
(74) *Attorney, Agent, or Firm*—Richard W. Ellis

(57) ABSTRACT

A gas/liquid separation element is provided comprising: a frame having an opening therein; waterproof/moisture permeable sheets affixed to both sides thereof so as to cover the opening, whereby the frame and waterproof/moisture permeable sheets define a liquid flow channel; a plurality of ribs arranged over at least the front face of waterproof/moisture permeable sheets and extending between two opposite sides of the frame; and a liquid inlet/outlet portion for liquid feed or liquid outlet, provided at one or more locations in a portion of the frame. Also provided are gas/liquid separators and separation units for use in gas/liquid separation applications such as humidifiers and dehumidifiers.

64 Claims, 9 Drawing Sheets

C–C'

B–B'

A–A'

D–D'

GAS/LIQUID SEPARATION DEVICES

BACKGROUND OF THE INVENTION

1. Field of the Invention

The present invention relates to a gas/liquid separation element, a gas/liquid separator and a gas/liquid separation unit for use in a wide range of gas/liquid separation applications, and in particular to a humidifying element, humidifier and humidifier unit adapted for use in a wide range of air conditioning applications requiring humidification, and especially in humidified air conditioning applications for office buildings, factory environments, households and vehicles.

2. Description of Related Art

To date, gas/liquid separators employing gas/liquid separation membranes to separate gases from liquids have been employed in various fields such as humidification, dehumidification, degassing, gas dissolving and so on (gas dissolving, i.e. dissolving a gas into a liquid, is included in the definition of gas/liquid separation herein). In particular, membrane type humidifiers have enjoyed a sudden surge in popularity in recent years due to their more efficient and cleaner humidification relative to the evaporator plate type humidifiers used to date.

Humidifiers of this type, namely, moisture permeable membrane type humidifiers employing porous sheeting hydrophilic polymer material (herein below also termed "first type humidifiers"), have been proposed (Unexamined Patent Applications H05-286039, H07-4701). Humidifiers of this kind employ a tubular membrane element formed from sheet material, which itself is a laminate of reinforcing material with a hydrophobic polymer membrane that blocks passage of water, but allows water vapor to pass. A liquid spacer is arranged within the tubular membrane element to ensure an internal flow channel for the humidification water, which is coiled into a spiral configuration together with a corrugated spacer for ensuring a gas flow channel, and accommodated within a mounting frame. In some instances an air bleed line is provided to enhance humidification efficiency.

To operate a first type humidifier, humidifying water is supplied into the tubular membrane element from a water inlet, and air is introduced into an opening in the mounting frame. The water inside the tubular membrane element is released in the form of water vapor through the hydrophilic polymer membrane, to effect humidification.

Humidifiers of the first type, however, have a number of problems, such as the following.

(1) A pinhole or liquid flow channel blockage, even at a single location in the tubular membrane, may result in the entire humidifier becoming nonfunctional, or in reduced humidifying performance.
(2) The tubular membrane may expand due to the pressure of the humidification water, thereby constricting the gas flow passage, resulting in increased pressure loss in the gas system and diminished gas flow. Expansion of the tubular membrane may also result in increased contact area between the waterproof/moisture permeable membrane and the corrugated spacer defining the gas flow channel, so that humidifying performance is depressed.
(3) The corrugated spacer for defining the gas flow channel has a large number of peaks spaced at relatively small intervals so as to ensure gas flow, as a result of which there is a large contact area between the corrugated spacer and the waterproof/moisture permeable membrane, and significant loss of humidifying performance.
(4) In order to achieve the desired humidifying performance, it is necessary to coil a very long tubular membrane (as long as 10 m or more) together with a corrugated spacer to produce the humidifier, resulting in a complex manufacturing process and high costs.
(5) It is necessary for tubular membrane connections to the water feed line or air bleed line to be liquid-tight; the difficulty of fabrication of these components results in significant loss, and consequently increased cost.

A humidifier plate type has been proposed by way of another type of humidifier (herein below also termed "second type humidifier") (Unexamined Patent Application H08-128682). This kind of humidifier has a structure wherein a stack of a plurality of independent humidifier plates (these consist of porous films of hydrophobic polymer) of thin foliate configuration is accommodated within a mounting frame, with each humidifier plate having waterproof/moisture permeable membrane stacked on the two principal faces of a frame having an opening therein, and with the humidifier plate supplied with water from an end thereof to a humidifier portion situated between the waterproof/moisture permeable membranes in the frame. Accordingly, each frame is thicker in the portion thereof defining the water feed portion than in the portion thereof defining the humidifier portion; the humidifier plates are stacked together with the water feed portions thereof juxtaposed, so that gaps are produced between humidifier plates due to the thickness difference between the water feed portion and humidifier portion of the frame, to ensure that gaps, serving as gas flow channels, are present between the humidifier plates.

To operate a second type of humidifier of this kind, humidifying water is supplied from a water inlet, and air is introduced into an air inlet opening in the mounting frame. The water supplied to the humidifier plates is released in the form of water vapor through the hydrophobic polymer membrane, to effect humidification.

However, since the design of the humidifier of the second type employs a stack of a plurality of humidifier plates of thin foliar configuration, while problems (1) and (4) pertaining to the humidifier of the first type described above are solved, other problems, such as the following, remain.

(1) Where no corrugated spacer is used in the gas flow channel, the waterproof/moisture permeable membranes can expand due to water pressure, thereby constricting the gas flow passage, resulting in increased pressure loss in the gas system and diminished air flow. Deformation of the waterproof/moisture permeable membranes can be reduced to some extent by providing the frame with ribs (the back face of the waterproof/moisture permeable membrane being stuck to the ribs), but where water pressure is high the waterproof/moisture permeable membrane will tend to come away from the rib, possibly resulting in rupture of the waterproof/moisture permeable membrane and water leakage.
(2) Where a corrugated spacer is used in the gas flow channel, the corrugated spacer that defines the gas flow channel will have a large number of peaks spaced at relatively small intervals so as to ensure gas flow, as a result of which will be a large contact area between the corrugated spacer and the waterproof/moisture permeable membrane, and significant loss of humidifying performance. High water pressure will result in larger contact area between the waterproof/moisture permeable membrane and the corrugated spacer, depressing humidifying performance.

(3) Fabricating a humidifier composed of a stack of a plurality of humidifier plates involves first bonding or fusing waterproof/moisture permeable membranes to a frame to produce the humidifier plate, and then stacking and bonding the desired number of humidifier plates one at time, resulting in a production process that is complicated, involves numerous steps, and is costly.

(4) Since the water feed portion of the humidifier plate has an open mouth structure, individual humidifier plates cannot be inspected for pressure-induced water leaks; rather the assembled humidifier must be inspected for pressure-induced water leaks, so leakage in even a single humidifier plate renders the entire humidifier unusable.

As yet another type of humidifier, there has been proposed one employing a humidifier sheet of unified triple-layer construction (herein below also termed "third type humidifier") (Unexamined Patent Application 2000-274754). This kind of humidifier employs a humidifier sheet of unified triple-layer construction, comprising waterproof/moisture vapor permeable membranes that block passage of water but allow passage of water vapor, arranged on both sides of a humidifying water retaining layer for accommodating and retaining water for humidification. The humidifying water retaining layer consists of cloth having a three-dimensional configuration, composed of a facing fabric, a backing fabric, and connecting threads connecting these at predetermined intervals over the entire extension thereof. The three-dimensional cloth is composed of hydrophobic polymer material, subjected to hydrophilic treatment. The humidifying element is produced by producing a through-hole at a predetermined location in the humidifier sheet, the side wall of the through-hole constituting a water inlet, with the peripheral side portions of the humidifying element having a sealed structure to prevent passage of at least water. A plurality of these humidifying elements are arranged in parallel, via spacers, within a mounting frame composed of upper and lower fixing covers and side panels, placing them within the mounting frame either flat or folded in a pleated configuration, or coiled into a coiled configuration with an intervening corrugated spacer, to assure a gas flow passage.

To operate a third type of humidifier of this kind, humidifying water is supplied from a water inlet, and air is introduced into an opening in the mounting frame. The water supplied to the humidifier plates is released in the form of water vapor through the hydrophobic polymer membrane, to effect humidification.

The third type of humidifier employs a humidifier sheet of unified triple-layer construction comprising a humidifying water retaining layer and waterproof/moisture permeable membranes, and as such the waterproof/moisture permeable membranes are more resistant to deformation than are the waterproof/moisture permeable membranes used in humidifiers of the second type, but nevertheless has room for improvement with regard to the following points.

(1) As the liquid flow channel is formed by cloth of three-dimensional structure, it is susceptible to deposits on fiber surfaces of foreign matter or impurities (such as rust, algae etc.) and tends to clog. Additionally the high cost of the three-dimensional cloth is a significant factor contributing to higher overall cost of the humidifier.

(2) Where the unit is used at high water pressure, stress is produced at the waterproof/moisture permeable membrane/three-dimensional cloth interfaces, making it necessary to control water pressure so that the humidifier is not subjected to excessive pressure. This imposes significant limits in terms of device design.

(3) The corrugated spacer that defines the gas flow channel will have a large number of peaks spaced at relatively small intervals so as to ensure gas flow, as a result of which will be a large contact area between the corrugated spacer and the waterproof/moisture permeable membrane, and significant loss of humidifying performance.

(4) Since construction of the unit by stacking a plurality of humidifier sheets involves first fabricating humidifier units by bonding a humidifier element and corrugated spacer in proximity to the through-hole in the humidifier element, and then stacking and bonding together the desired number of humidifier units one at a time while aligning the through-holes, this results in a production process that is complicated, involves numerous steps, and is costly. Further, it is necessary to ensure that the connected portions around the through-holes are liquid-tight; the difficulty of fabrication of these components results in significant loss, and consequently increased cost.

These and other purposes of the present invention will become evident from review of the following specification.

SUMMARY OF THE INVENTION

The present invention provides a gas/liquid separation element that does not expand when pressurized by liquid feed; that requires no separate components such as reinforcing members or gas flow channel spacers; that is readily assembled with a mounting frame so as to provide low production costs; that effectively prevents clogging and blockage; that effectively prevents bulging of the waterproof/moisture permeable membranes; that has excellent stability over prolonged periods; and that is particularly useful for humidification and dehumidification applications. Also provided are a gas/liquid separator and gas/liquid separation unit employing this element.

The present invention is a gas/liquid separation element comprising: a preferably thin frame having an opening therein; waterproof/moisture permeable sheets affixed to both sides thereof so as to cover the opening, whereby said frame and said waterproof/moisture permeable sheets define a liquid flow channel; a plurality of ribs arranged over the front face of said waterproof/moisture permeable sheets, and extending between two opposite sides of said frame; and a liquid inlet/outlet portion for liquid feed or liquid outlet, provided at one or more locations in a portion of said frame.

In another embodiment, the invention provides a gas/liquid separation element comprising: a preferably thin frame having an opening; waterproof/moisture permeable sheets affixed to both sides thereof so as to cover the opening, whereby said frame and said waterproof/moisture permeable sheets define a liquid flow channel; a plurality of ribs arranged over the front and back faces of said waterproof/moisture permeable sheets, with said ribs arranged over said back faces being partially cut away; and a liquid inlet/outlet portion for liquid feed or liquid outlet, provided at one or more locations in a portion of said frame.

In another embodiment, the invention provides a gas/liquid separation element comprising: two gas/liquid separation element materials, each said material comprising a frame of having an opening; a waterproof/moisture permeable sheet affixed to the front face thereof so as to cover the opening, a plurality of ribs arranged over the front face of said waterproof/moisture permeable sheet, and extending between two opposite sides of said frame, with said materials being juxtaposed back-to-back and unified by bonding or fusing, and said frame and said waterproof/moisture permeable sheets defining a liquid flow channel; and a liquid inlet/outlet portion for liquid feed or liquid outlet, provided at one or more locations in a portion of said frame.

In another embodiment, the invention provides a gas/liquid separation element comprising: two gas/liquid separation element materials, each said material comprising a frame having an opening; a waterproof/moisture permeable sheet affixed to the front face thereof so as to cover the opening, a plurality of ribs arranged over the front and back faces of said waterproof/moisture permeable sheet, and extending between two opposite sides of said frame, with said materials being juxtaposed back-to-back and unified by bonding or fusing; said frame and said waterproof/moisture permeable sheets defining a liquid flow channel, and said ribs arranged over said back faces being partially cut away; and a liquid inlet/outlet portion for liquid feed or liquid outlet, provided at one or more locations in a portion of said frame.

DESCRIPTION OF THE DRAWINGS

The operation of the present invention should become apparent from the following description when considered in conjunction with the accompanying drawings, in which.

DETAILED DESCRIPTION OF THE INVENTION

A fuller understanding of the gas/liquid separation element herein is provided by the following detailed description made with reference to the accompanying drawings, taking the specific example of a humidifier element for use in humidification.

Figure 1:
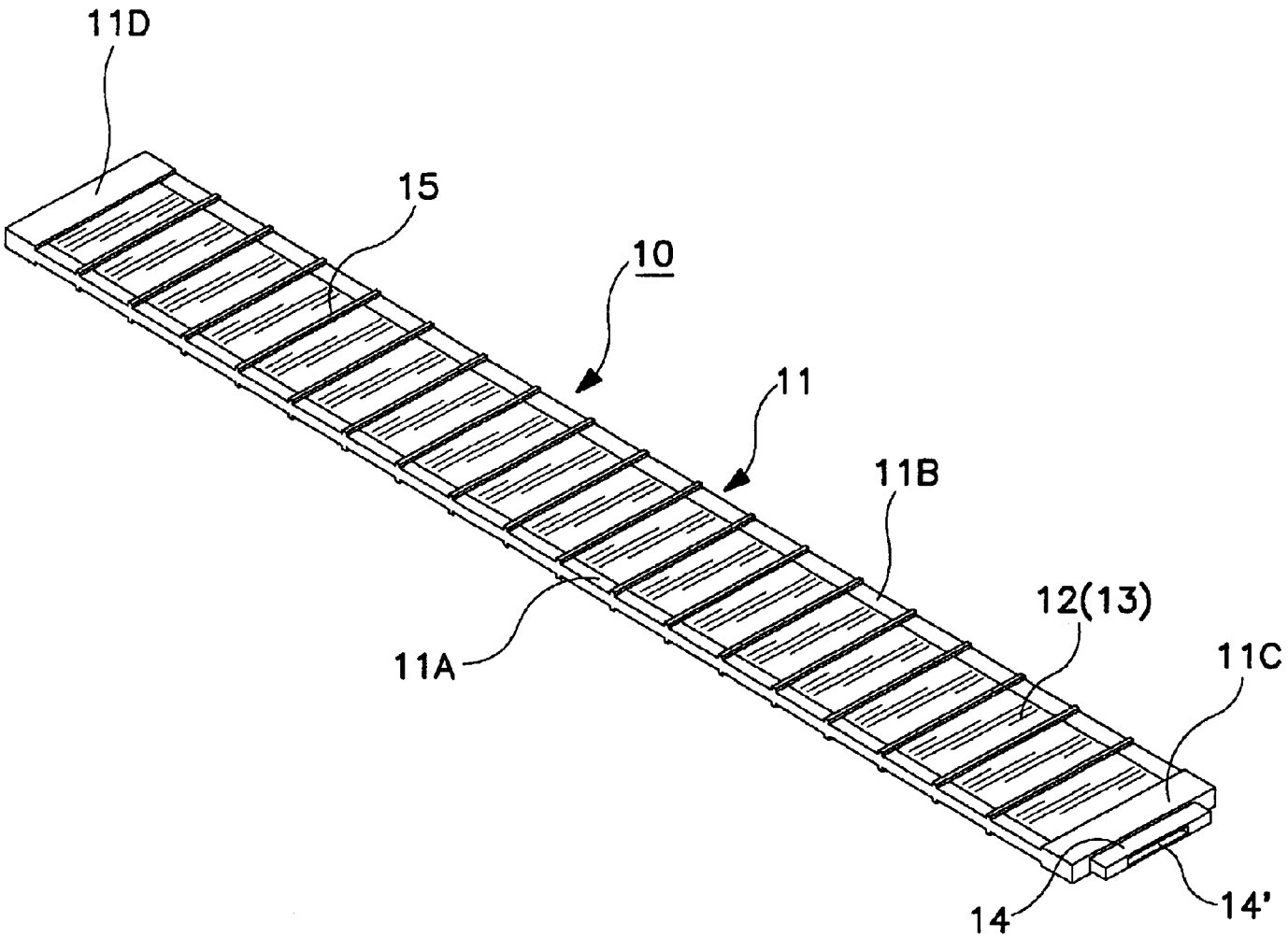
FIG. 1 is a perspective view showing the overall configuration of an exemplary humidifier element according to the invention.
Figure 2A:
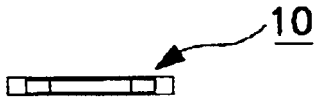
FIG. 2(*a*) is a side view of the humidifier element of FIG. 1; (*b*) is a plan view thereof; and (*c*) is a front view thereof.
Figure 2B:
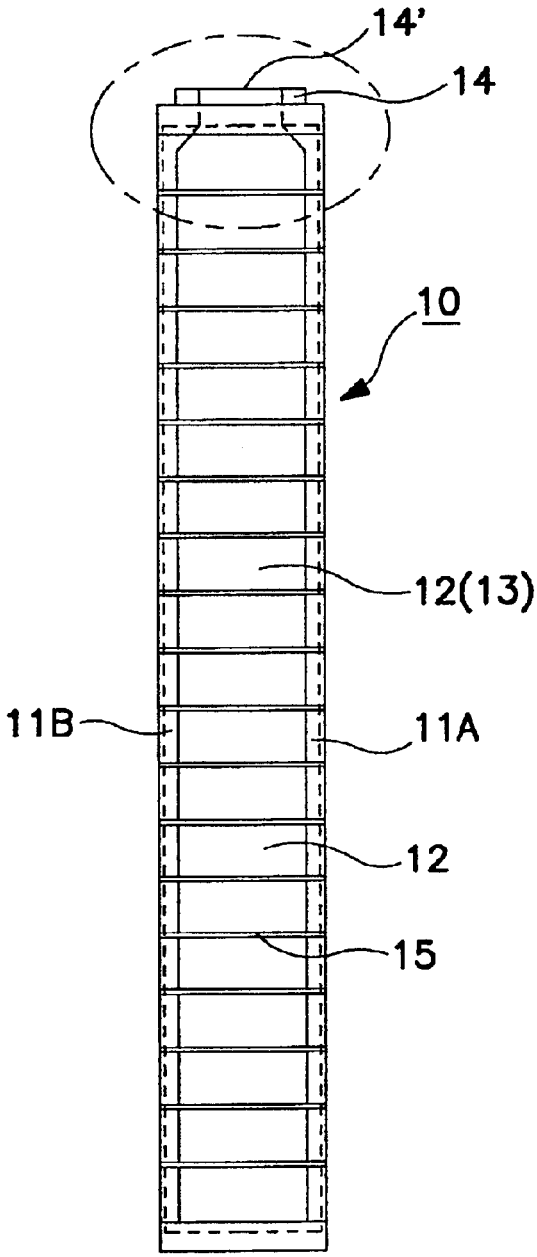
Figure 2C:
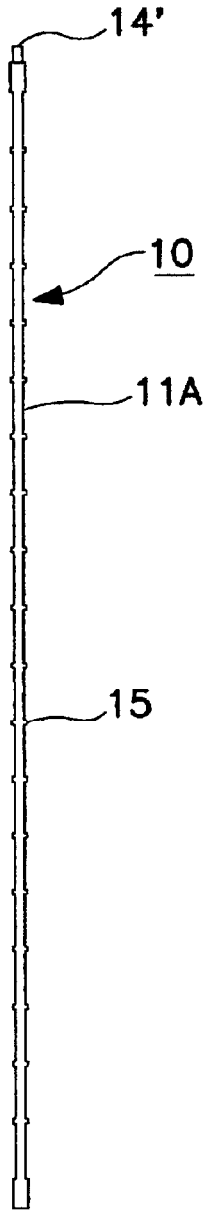
Figure 3:
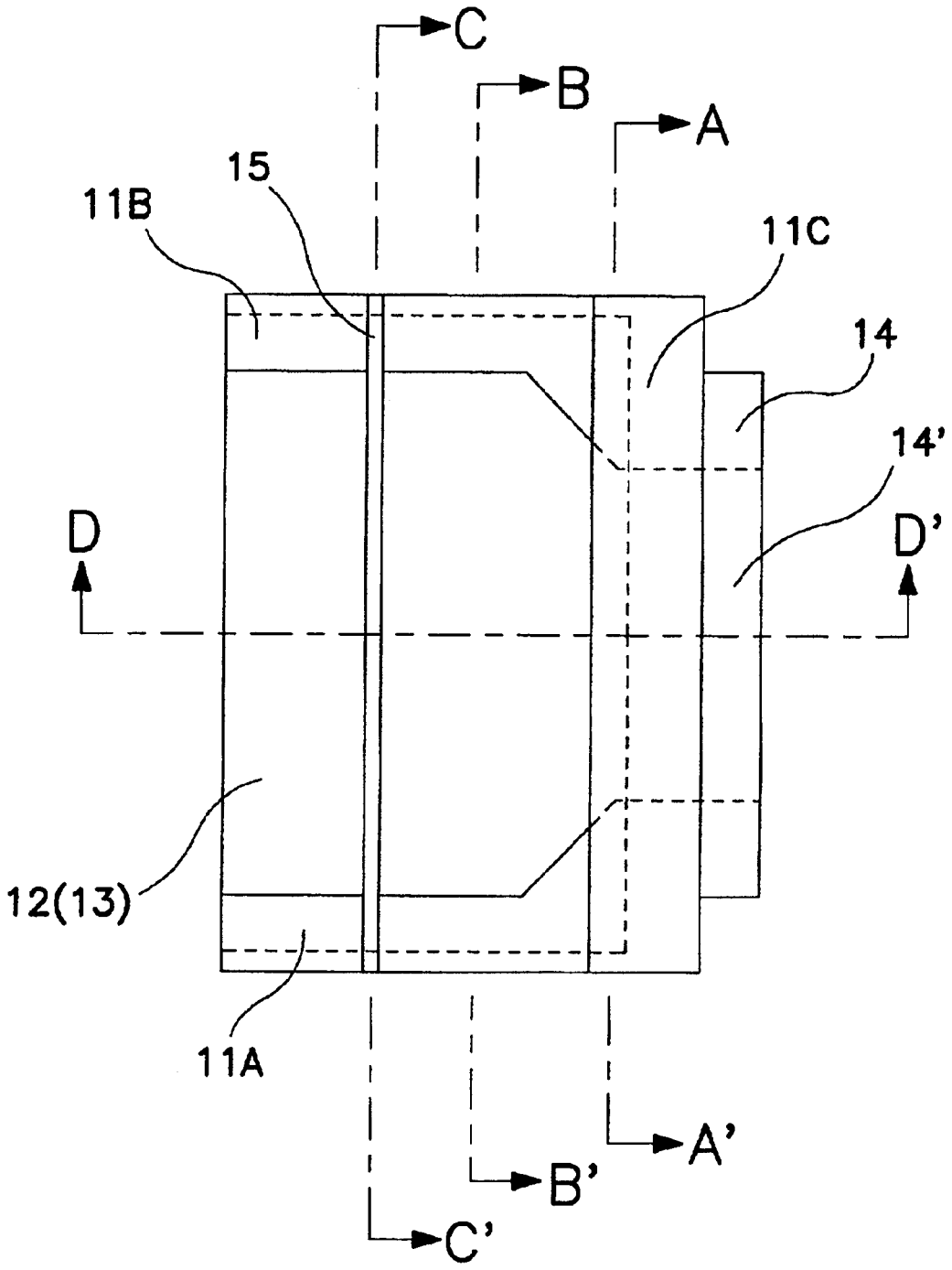
FIG. 3 is a fragmentary plan view of the humidifier element of FIG. 1, showing the water feed port portion enlarged.
Figure 4C:
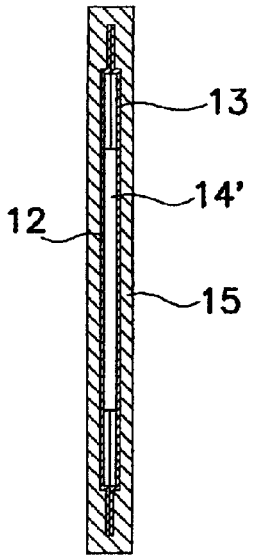
FIG. 4(*a*) is a sectional view taken along line A–A' in FIG. 1, (*b*) is a sectional view taken along line B–B', (*c*) is a sectional view taken along line C–C', and (*d*) is a sectional view taken along line D–D'.
Figure 4B:
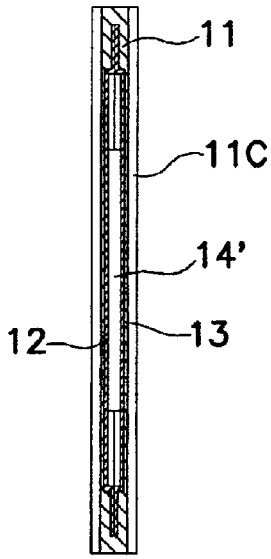
Figure 4A:
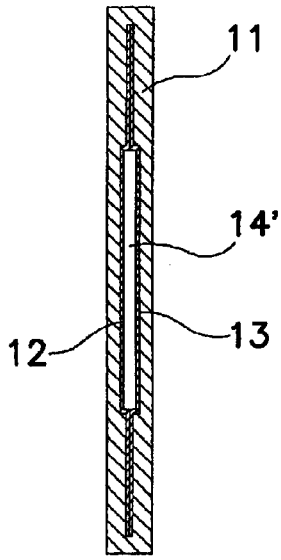
Figure 4D:
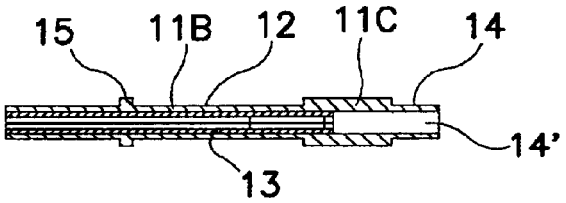

FIG. 1 is a perspective view showing the overall configuration of an exemplary humidifier element according to the invention. FIG. 2(*a*) is a side view; (*b*) is a plan view; and (*c*) is a front view. FIG. 3 is a fragmentary plan view showing the water feed port portion enlarged. FIGS. 4(*a*)–(*d*) are linear sectional views respectively taken along lines A–A', B–B', C–C' and D–D' in FIG. 3.

As shown in the drawings, humidifier element 10 herein comprises a frame 11 produced by removing an interior portion of a thin rectangular plate to form an opening, and waterproof/moisture permeable sheets 12, 13 affixed to either side thereof, covering the opening. Apart from a water inlet/outlet portion 14, the waterproof/moisture permeable sheets 12, 13 provided to the frame 11 produce a hermetic liquid flow passage (humidifier portion) that does not allow humidification water to pass. On the front faces of the waterproof/moisture permeable sheets 12, 13 there are arranged a plurality of ribs 15 extending between a pair of opposing sides 11A, 11B of frame 11, i.e., in the cross direction of frame 11. The ribs 15 have the function of defining an air flow passage between humidifier elements 10 when humidifier elements 10 are assembled into a humidifier, and also serve to maintain proper shape in the humidifier portion formed by the waterproof/moisture permeable sheets 12, 13. At a first end of frame 11 there is provided a water inlet/outlet portion 14, within which is formed a water inlet/outlet orifice 14' that communicates with the liquid flow passage. The end of frame 11 opposite the water inlet/outlet portion 14 is closed. In other words, the water inlet/outlet orifice in this humidifier element is situated at a single location.

Materials for frame 11 may be selected from any number of rigid materials, such as ABS, polyethylene, polypropylene, nylon, POM, PPS, polyvinyl chloride, acrylic, polycarbonate and other plastics; or aluminum, stainless steel, titanium and other metal alloy materials. The configuration of frame 11 is not critical provided that the aforementioned liquid flow passage (humidifier portion) is formed therein; however, an approximately rectangular configuration is preferable in terms of maximizing waterproof/moisture permeable membrane area for a given humidifier volume. The dimensions of frame 11 may be selected appropriately with reference to the size of the humidifier being produced; typical dimensions are thickness of about 0.5 to about 10 mm at sides 11A and 11B; thickness of about 0.5 to about 20 mm at sides 11C and 11D; a lengthwise dimension of about 20 to about 500 mm; a crosswise dimension of about 20 to about 500 mm; side 11A, 11B width of about 2 to about 20 mm; and side 11C, 11D width of about 2 to about 30 mm. Thinner sides 11A, 11B, 11C, 11D afford greater waterproof/moisture permeable membrane area for a given humidifier volume and higher humidification efficiency, but if thinner than 0.5 mm, pressure loss may increase excessively, and the element may lack strength, causing the element to deform due to water pressure.

In a preferred embodiment of the humidifier element herein, the cross-sectional profile of the edge portions of frame 11 against which air will be directed when the humidifier is assembled, that is, the cross-sectional profile of the portion extending from the air inlet into the voided portion and/or the profile of the portion extending from the voided portion to the air outlet, will be of streamlined or other profile providing minimal air flow resistance, in order to minimize pressure loss in the air system.

Any of a number of materials may be used for waterproof/moisture permeable sheets 12, 13 provided that these are waterproof and moisture permeable, i.e. do not allow liquids (such as water) to pass, while allowing water vapor to pass; representative examples are waterproof/moisture permeable membranes, and waterproof/moisture permeable membrane/protective sheet laminates. Waterproof/moisture permeable sheets will preferably have a high degree of moisture permeability, typically 5,000–150,000 g/m$^2$·day, preferably 10,000–100,000 g/m$^2$·day, and more preferably 20,000–70,000 g/m$^2$·day. Moisture permeability herein is measured in accordance with the method of JIS 1099-B1.

Porous polymer film is preferred for use as the waterproof/moisture permeable membrane herein. Typical porous polymer film materials include hydrophobic, porous membranes of polyethylene, polypropylene, polycarbonate, polytetrafluoroethylene, polytetrafluoroethylene/hexafluoropropylene copolymer, polyvinyl fluoride, polyvinylidene fluoride, etc.; porous polytetrafluoroethylene is preferred for its resistance to heat and chemicals. The porous polytetrafluoroethylene material will preferably have thickness of 1–1,000 $\mu$m, porosity of 5–95%, and pore size of 0.01–15 $\mu$m. In terms of achieving satisfactory levels of water vapor permeability, water resistance and strength, thickness of 20–200 $\mu$m, porosity of 60–90%, and pore size of 0.1–3 $\mu$m are preferred. Porous polytetrafluoroethylene materials of this kind may be produced by methods known in the art, such as stretching, solvent extraction or casting. Stretching provides excellent membrane strength, at relatively low cost. Methods for producing porous polytetrafluoroethylene by stretching are disclosed inter alia in Unexamined Patent Applications S46-7284, S50-22881 and H03-504876, and any of these known methods may be used.

The porous polytetrafluoroethylene membrane may be provided on one or both faces thereof with a continuous coating of hydrophilic polymer, e.g. at least partly crosslinked polyvinyl alcohol, cellulose acetate, or cellulose nitrate, or with a polyamino acid, polyurethane resin, fluororesin, silicone resin or other hydrophilic resin, as taught in the publications mentioned above.

The porous polytetrafluoroethylene membrane may also be coated on the porous matrix surfaces thereof with an organic polymer having water repellency and oil repellency, in such as way as to leave open cells, as taught in the publications mentioned above. For example, a fluorinated surfactant (e.g. ammonium perfluorooctanoate) may be used to produce an aqueous emulsion of a polymer derived by polymerization of a fluoroalkyl acrylate and a fluoroalkyl methacrylate, applying the emulsion to the porous polytetrafluoroethylene membrane and heating it to form a film like that described above, as taught inter alia in WO94/22928 and WO/95/34583. Organic polymers for this purpose include binary or ternary copolymers of tetrafluoroethylene with monomers such as acrylate, methacrylate, styrene, acrylonitrile, vinyl, allyl or alkene, preferable examples being fluoroacrylate/tetrafluoroethylene copolymer, or fluoroacrylate/hexafluoropropylene/tetrafluoroethylene. The above copolymers excel in terms of resistance to soiling, heat and chemicals, and also conform and bond securely to porous matrix surfaces. Other organic polymers include AF POLYMER (trademark of DuPont) and CYTOP (trademark of Asahi Glass). The organic polymer may be coated onto the porous matrix surfaces of the porous polymer film by first dissolving the polymer in an inert solvent, such as FLUORINERT (trademark of 3M), impregnating this into the porous polymer film, and then evaporating out the solvent.

Alternatively, waterproof/moisture permeable sheets 12, 13 may consist of laminate material of waterproof/moisture permeable membrane with a protective sheet as a reinforcing layer. The protective sheet may take the form of woven, knit or nonwoven fabric, netting, expanded sheeting, porous film etc., but woven, knit and nonwoven fabrics are preferred for their excellent reinforcement, pliability and low cost. Materials for these include polyethylene, polypropylene, polyester, nylon, polyurethane, polyvinyl chloride and other resin materials, metals, glass and so on. Textile fabrics such as woven, knit and nonwoven fabrics will preferably be composed of core/sheath fibers. By using a resin material with a lower melting point than the core component as the sheath component (for example, a polyester core and a polyethylene sheath), the process of fusing the waterproof/moisture permeable membrane and protective sheet when thermally laminating these may be facilitated. Where a protective sheet is used, thickness thereof is from 5 $\mu$m to 5 mm, preferably about 10 $\mu$m to 1 mm. Thickness of less than 5 $\mu$m will not provide adequate protection, whereas in excess of 5 mm the waterproof/moisture permeable sheet will be thicker, and consequently the humidifier will be bulky.

Protective sheeting may be laminated to one or both sides of the waterproof/moisture permeable membrane; in preferred practice, however, protective sheeting will be provided on one side only, and the product used with the waterproof/moisture permeable membrane arranged facing the air system, so as to provide good humidification efficiency. Where the waterproof/moisture permeable membrane is situated on the air system side, diffusion resistance on the air system side is fairly low, allowing water vapor passing through the waterproof/moisture permeable membrane to rapidly diffuse into the air.

Methods for laminating protective sheeting to the waterproof/moisture permeable membrane include applying adhesive to the waterproof/moisture permeable membrane with a gravure-patterned roll, and then arranging protective sheeting thereon and compressing with a roll; spraying adhesive onto the waterproof/moisture permeable membrane, and then arranging protective sheeting thereon and compressing with a roll; thermally fusing the juxtaposed waterproof/moisture permeable membrane and protective sheeting using a heated roll; or other such methods known in the art. Where adhesives are used, urethane, polypropylene, polyethylene, epoxy, silicone or other such adhesives may be used. The waterproof/moisture permeable membrane and protective sheeting will have contact area of 3 to 95%, preferably 10 to 50%. Contact area of less than 3% will result in inadequate bonding strength between the waterproof/moisture permeable membrane and protective sheeting, while adequate humidifying ability is not achieved in excess of 95%.

As noted, ribs 15 perform the functions of defining an air flow passage between humidifier elements, and maintaining proper shape in the humidifier portion (i.e. preventing excessive bulging). Materials, like those for frame 11, may be selected from any number of rigid materials, such as ABS, polyethylene, polypropylene, nylon, POM, PPS, polyvinyl chloride, acrylic, polycarbonate and other plastics; or aluminum, stainless steel, titanium and other metal alloy materials. The material may be the same as or different from that used for frame 11.

Rib 15 thickness and placement are not critical provided that space for a proper air flow passage is maintained; typically, ribs are from 0.1 to 10 mm, and arranged substantially parallel to sides 11C and 11D, at intervals of 5–100 mm; preferred values are thickness of from 0.3 to 3 mm and spacing of 10 to 30 mm. For a given number of humidifier elements and waterproof/moisture permeable sheet dimensions, physical properties and air flow rate, thinner ribs 15 allow for faster flow speeds of air contacting the waterproof/moisture permeable membrane, and consequently increased humidifying action. On the other hand, thicker ribs 15 will increase air resistance. Accordingly rib 15 thickness is a design element that must be selected with reference to the performance required of the humidifier element.

The two ends of each rib 15 may be at least partially joined and unified with sides 11A and 11B. Unifying the ends of the ribs at least in part with sides 11A and 11B allows stress created by water pressure on the humidifier element, in a direction inducing the waterproof/moisture permeable membranes 12, 13 to bulge outward, to be borne by the frame as whole. Rib 15 placement may be substantially parallel to sides 11A and 11B, or an arrangement such that a plurality of ribs intersect at locations over the waterproof/moisture permeable membrane; in this latter instance, it may be necessary to cut away portions of the ribs 15 to ensure an air flow passage.

Ribs 15 may be provided as physically separate elements from waterproof/moisture permeable membranes 12, 13, or fused and unified therewith.

Figure 5:
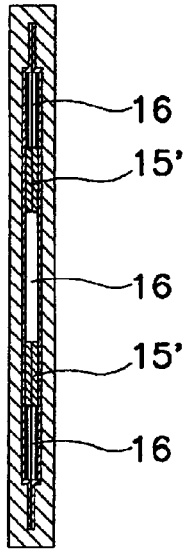
FIG. 5 is a sectional view of an example additionally provided with ribs on the back face of the waterproof/moisture permeable sheet.

In the exemplary arrangement described above, ribs 15 are provided only on the front faces of waterproof/moisture permeable membranes 12, 13, but where additional reinforcement of the humidifier element is the goal, ribs may be provided on the back faces of waterproof/moisture permeable membranes 12, 13 as well. This arrangement is illustrated in, FIG. 5 (FIG. 5 is analogous to a linear sectional view taken along line C–C' in FIG. 3.) Symbol 15' denotes ribs provided on the back faces of waterproof/moisture permeable membranes 12, 13; in this example, the two ribs 15' [provided to the respective membranes] are merely juxtaposed, but could be unified instead. Where ribs 15' are provided, extension of these over the entire cross direction will prevent passage of humidifying water, so it will be necessary to provide cutouts 16 to allow humidifying water to pass through the element. The number and dimensions of the cutouts will be selected appropriately for the desired balance of reinforcement and passage of humidifying water.

Ribs 15' may be provided as physically separate elements from waterproof/moisture permeable membranes 12, 13, or fused and unified therewith.

Figure 6:
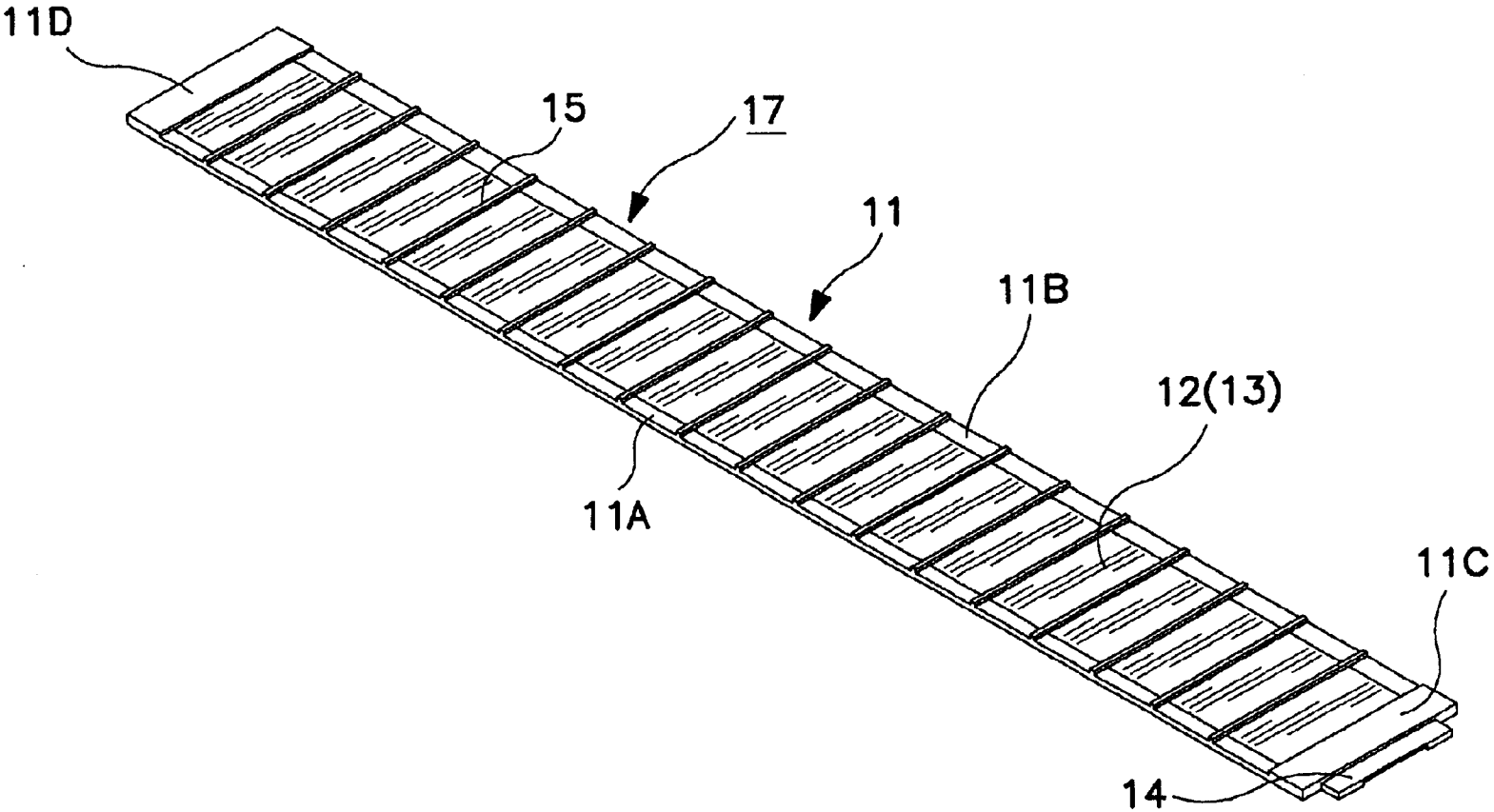
FIG. 6 is a perspective view showing the overall configuration of an exemplary humidifier element material.
Figure 7:
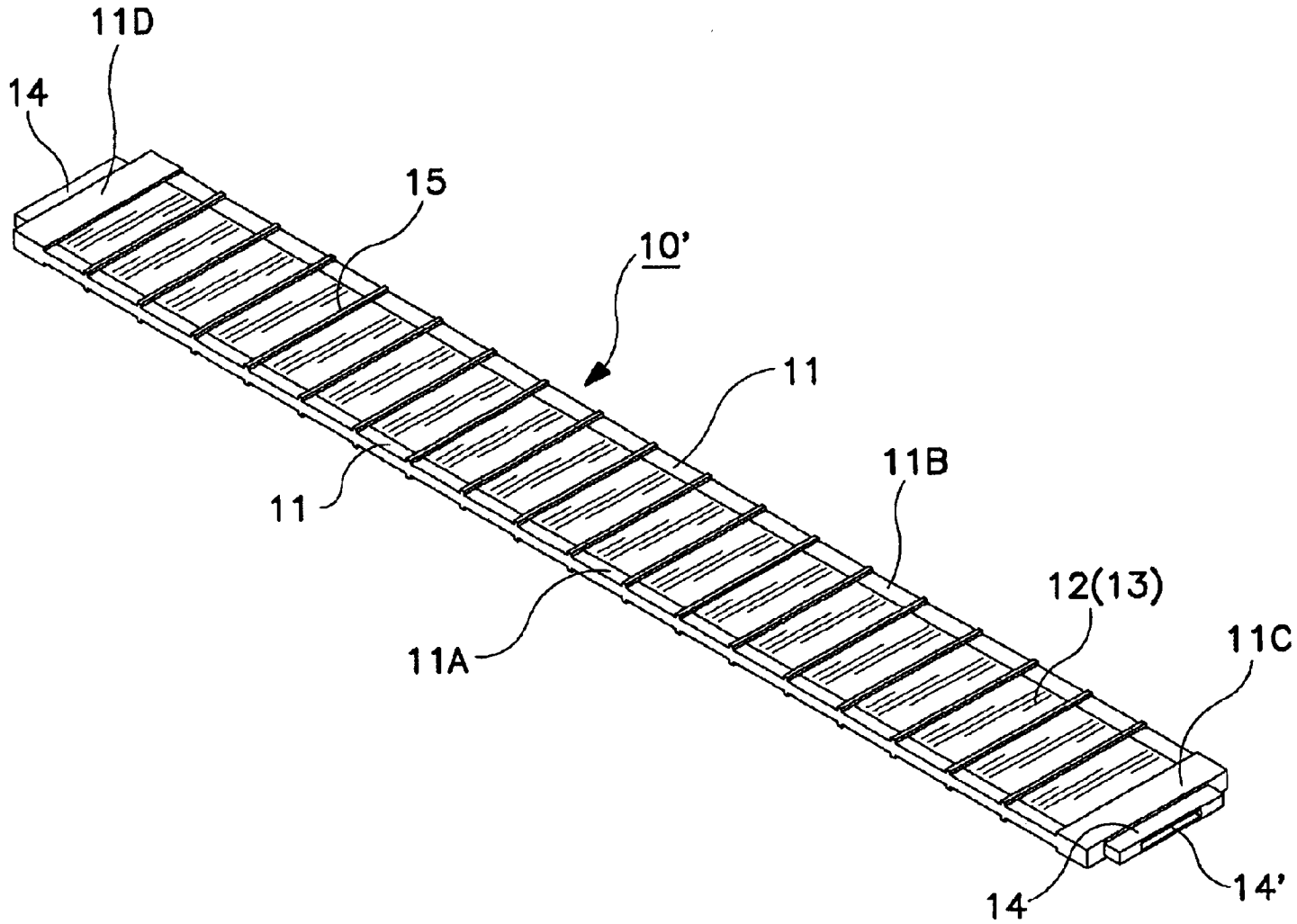
FIG. 7 is a perspective view showing the obverse of the humidifier element material of FIG. 6.

Methods for affixing the waterproof/moisture permeable sheets 12, 13 to the frame 11 include affixing the waterproof/moisture permeable sheets 12, 13 through integral molding thereof when molding the frame 11 (where frame 11 is plastic); adhesively bonding them to frame 11 with a urethane, polypropylene, polyethylene, epoxy, silicone, solvent, acrylic or other adhesive; fusion by methods such as ultrasonic fusion, high frequency fusion, thermal fusion etc. (where frame 11 or waterproof/moisture permeable sheets 12, 13 are thermoplastic), or other known techniques.

Where a molding process is selected as the fixing method, the use of injection molding is especially preferred as it allows for simultaneous integral molding of the waterproof/moisture permeable sheets, frame and ribs. In an injection molding process, injection molding is used to integrally mold a humidifier element material 17 in which a waterproof/moisture permeable sheet is fixed to the surface of a frame having an opening therein produced by injection molding, so as to cover the opening, and a plurality of ribs extend over the surface of the waterproof/moisture permeable sheet, between a pair of opposing sides of the frame. Two of these humidifier element materials 17 are then stacked back-to-back and unified adhesively or by fusion to produce a humidifier element. The humidifier element material is shown in perspective view in FIGS. 6 and 7. FIG. 6 shows the humidifier element material viewed from the side thereof provided with ribs 15, and FIG. 7 shows the obverse.

The injection molding process entails first setting the waterproof/moisture permeable sheet on the lower mold of the injection mold assembly; closing the lower and upper molds; injecting resin to effect injection molding; and then parting the lower and upper molds. Setting of the waterproof/moisture permeable sheet may be accomplished by securing with pins, by suction provided by a vacuum pump, etc. Where injection molding is used, the material may consist of any injection-moldable resin, although ABS resin is preferred for its excellent resistance to heat and water, and ease of fusion. Where injection molding is conducted using ABS resin, preferred process parameters for injection molding are an injection temperature of 190–240° C., injection time of 5–20 sec, cooling time of 5–20 sec, and mold temperature or 50–70° C.

The method for adhesively joining or fusing two humidifier elements back-to-back to unify them may be selected from any of a number of methods affording watertight joining/unification, such as methods using urethane, polypropylene, polyethylene, epoxy, silicone, solvent, acrylic or other adhesives; or methods such as ultrasonic fusion, high frequency fusion, thermal fusion etc.

As the method of attaching ribs 15, 15', where frame 11 is produced by a molding process, ribs may be molded simultaneously with frame 11; or attached afterward. Where attached afterward, methods such as adhesion, fusion, solvent welding, etc. may be employed.

In the above exemplary arrangement, water inlet/outlet portion 14 extends out from the center of the sidewall at a lengthwise end of the humidifier element; apart from the water inlet/outlet orifice 14', the water inlet/outlet portion 14 must be unified in watertight fashion. The position, configuration and dimensions of water inlet/outlet orifice 14' and water inlet/outlet portion 14 may be selected as appropriate to provide the proper supply of humidifying water into the humidifier element. Alternatively the water inlet/outlet portion 14 may be omitted, instead providing water inlet/outlet orifice 14' to a side 11C, 11D of the humidifier element; however, considerations pertaining to joining with the mounting frame make it preferable to provide a water inlet/outlet portion 14, since it is relatively easy to produce a watertight joint.

The description now turns to a humidifier according to the invention, employing the humidifier element described herein above.

Figure 8:
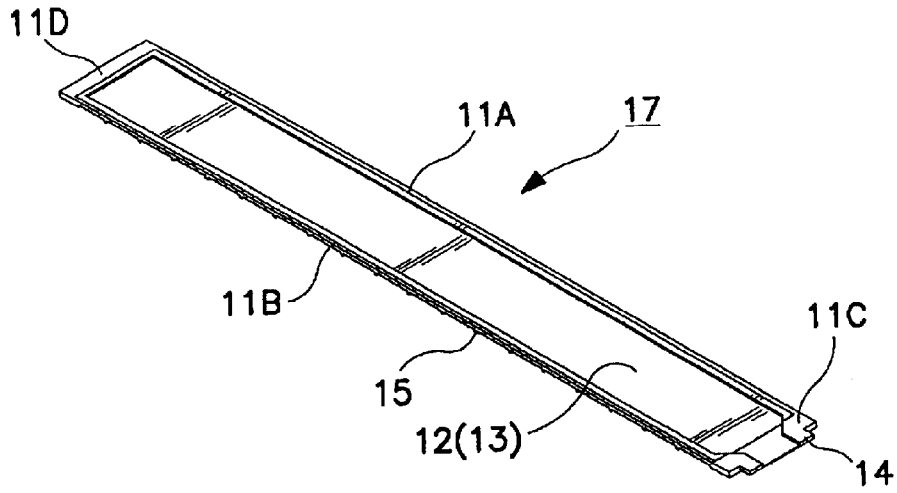
FIG. 8 is a partly cutaway perspective view showing the overall configuration of an exemplary humidifier (horizontal humidifier) of the invention.

The overall arrangement of a humidifier of the invention is shown in perspective view in FIG. 8. In the figure, 20 denotes the humidifier, comprising a stack 21 of a plurality of humidifier elements 10 stacked vertically, and open at the front and back to provide an air inlet and outlet. The stack 21 is enclosed about its perimeter with a mounting frame 22; a humidifying water inlet channel (not shown) extends vertically within one of the vertical frame piece 22A of the mounting frame 22. This humidifying water inlet channel connects at a suitable location at its lower end with a water inlet member 23, and at a suitable location at its upper end with a water outlet member 24. The water inlet/outlet portions 14 of the humidifier elements that make up the humidifier 20 connect to the water inlet member 23 (which serves as a common humidifying water inlet orifice) and to the water outlet member 24 (which serves as a common humidifying water outlet orifice), respectively connected in watertight fashion to the vertical frame piece 22A. It is preferable to provide the water inlet member 23 at the lower side of the humidifier and the water outlet member 24 at the upper side, so as to avoid air bubbles within the humidifier elements (i.e. a portion of the humidifier element does not fill with water, so that air remains).

When the humidifier elements 10 are stacked up, the upper and lower ribs 15 are juxtaposed with the edges 11C, 11D of the frames 11 so that air flow passage spaces 25 of corresponding thickness are produced between sides 11C and ribs 15, and sides 11D.

Figure 9:
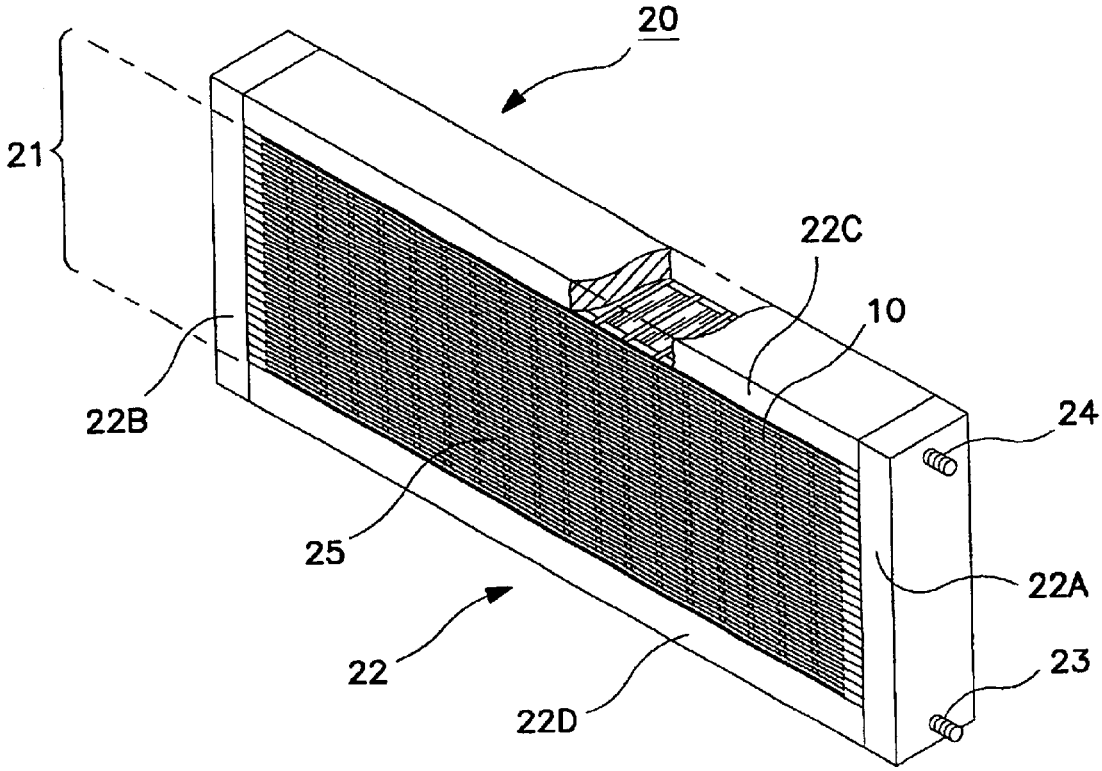
FIG. 9 is a perspective view showing the overall configuration of an exemplary humidifier element having water inlet/outlet portions at two locations on two sides.
Figure 10:
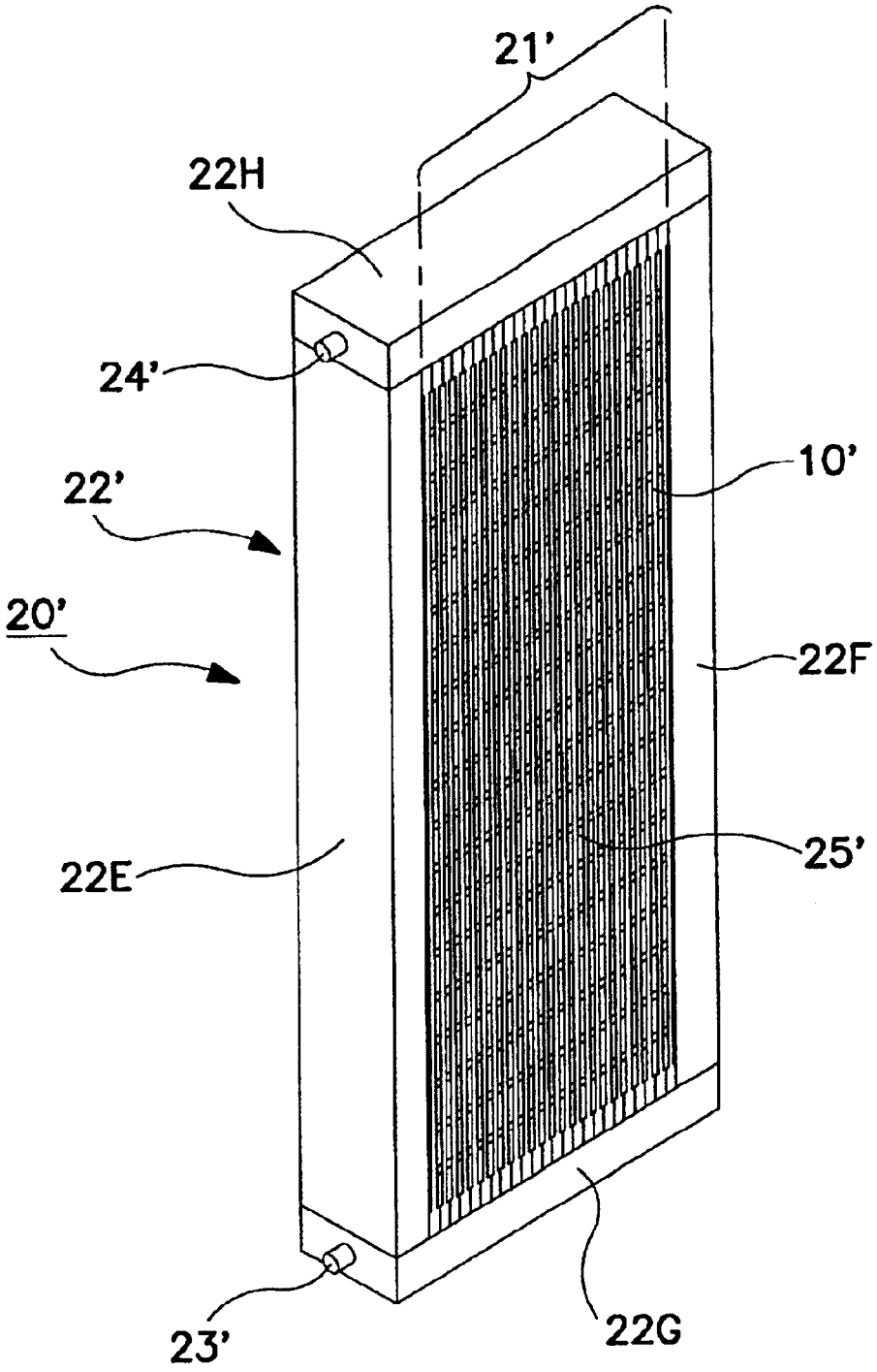
FIG. 10 is a perspective view showing the overall configuration of an exemplary veridical humidifier of the invention.

The exemplary arrangement described above is a horizontal humidifier employing humidifier elements that have a water inlet/outlet portion 14 at a single location on one side, with the water inlet member 23 and water outlet member 24 of the humidifier provided to a vertical frame piece 22A to which are connected the water inlet/outlet portions 14 of the humidifier elements 10; however, humidifier elements 10' having water inlet/outlet portions 14 at two locations situated on two sides, depicted in FIG. 9, could be used to produce a vertical humidifier like that shown in FIG. 10. Here, it is preferable to provide water inlet member 23' to lower horizontal frame piece 22G and water outlet member 24' to upper horizontal frame piece 22H. Reversing the positional relationship of water inlet member 23' and water outlet member 24' may result in air bubbles, depending on operating conditions.

In the illustrated example, humidifier 20 has a rectangular configuration, but depending on the application could have some other suitable three-dimensional shape.

Humidifier 20 dimensions may be selected as appropriate for a particular application.

Materials for the mounting frame 22 of humidifier 20 may be selected from any number of rigid materials, such as ABS, polyethylene, polypropylene, nylon, POM, PPS, polyvinyl chloride, acrylic, polycarbonate and other plastics; or aluminum, stainless steel, titanium and other metal alloy materials.

The humidifier elements 10 and mounting frame 22 may be assembled together, in the case of the arrangement illustrated in FIG. 8 for example, by joining the water inlet/outlet portions 14 and vertical frame piece 22A together in watertight fashion by means of adhesive bonding, fusion, mechanical fastening, solvent welding or other method. These same methods may also be used for joining to vertical frame piece 22B or horizontal frame pieces 22C, 22D. To take the example of vertical frame piece 22A, orifices of a size matching the water inlet/outlet portions 14 and equal in number to the number of humidifier elements 10 to be attached are made in vertical frame piece 22A; when joining the humidifier elements 10 with the vertical frame piece 22A, by inserting all of the humidifier elements 10 into the corresponding orifices in vertical frame piece 22A and joining them simultaneously using one of the above methods, a multitude of humidifier elements 10 can be mounted onto the mounting frame all at once. Here, the humidifier elements 10 may be simply stacked up; while gaps may be present between humidifier elements 10, if the gaps between humidifier elements 10 are too large the humidifier 20 will tend to be bulky. In preferred practice, humidifier elements 10 will be stacked such that no gaps are present between sides 11C, 11D and/or ribs 15 (i.e. these contact each other).

Where humidifier elements 10 and vertical frame piece 22A are joined with adhesive, urethane, polypropylene, polyethylene, epoxy, silicone or other such adhesives may be used.

Where fusion is used, methods such as ultrasonic fusion, high frequency fusion, thermal fusion etc. can be employed.

For mechanical fastening, humidifier elements 10 may be joined to vertical frame piece 22A with a O-ring or similar sealing member interposed between the water inlet/outlet portions 14 and the orifices in the frame, and fastened thereto with bolts and nuts.

The humidifier herein may be employed as a humidifier unit, by connecting a plurality thereof in series. One method for producing such a unit is to line up two or more humidifiers therein, connecting together their water inlet members and water outlet members, respectively, and situating the humidifying water inlet and humidifying water outlet at respective single locations. With this method, fabricating a relatively compact standard humidifier allows a number of these standard humidifiers to be connected together depending on the required humidifying capability, thus obviating the need to produce different humidifier models for different humidification requirements, which is advantageous from a cost standpoint.

The description now turns to an air conditioner and humidifier system employing the humidifier herein.

To take the example of a commercial air conditioning system equipped with a humidifying function, the humidifier or humidifier unit is installed in the air conditioning system and supplied with water through the water inlet, whereby water is supplied to the humidifier elements. When dry air is forced by means of a forced air fan through the air flow channels formed by ribs 15, the dry air flows across the surfaces of the waterproof/moisture permeable sheets, and the humidification water inside the humidifier elements evaporates through the waterproof/moisture permeable sheets, humidifying the air. The pressure of the humidification water supplied to the humidifier elements must be controlled to a level below the pressure which the humidifier elements can withstand. Methods for controlling water pressure include installing a humidification water supply tank above the humidifier, keeping the water level in the tank constant within a certain given range by means of a water level sensor, float switch, etc. so that water is supplied to the humidifier by a head differential; using a pressure reducing valve to lower water pressure; or other such method known in the art. Where space is limited, as with a compact air conditioner, it is preferable to use a pressure reducing valve. The humidifier is installed in such a way that air flowing through the air conditioner passed through the air flow passage of the humidifier. The humidifier mounting location can be any suitable location in the air duct extending from the air conditioner air intake to the blower outlet; however, where situated between the heat exchanger unit and the blower outlet, air heated by the heat exchanger unit can be passed through the humidifier to provide humidification in winter, when it is particularly needed; a high water vapor pressure differential between the humidification water and supplied air is preferable as it improves humidification efficiency. Forced air is typically delivered by a forced air fan, air pump, etc.; where intake of air from the outside is possible, as with an air conditioning system for a vehicle, no special mechanism is needed to deliver forced air.

In the case of a humidifier system for use in air conditioning of an office building or factory, the humidifier or humidifier unit is installed in the air conditioning system and supplied with humidification water through the humidifier water inlet, as with the air conditioning systems described above. The humidifier is arranged such that the humidifier elements are facing the direction of air flow through the duct. Air flowing through the duct is humidified as it passes through the air flow passages formed by the ribs 15 of the humidifier elements.

In the case of a humidifier system for household use, the humidifier, blower, humidification water pressure reducing valve, operation control unit, etc. will be located inside a casing, and when supplied with water through the humidifier water inlet, the water is supplied into the humidifier elements; when dry air forced by means of the blower flows across the surfaces of the waterproof/moisture permeable sheets, and the humidification water inside the humidifier elements evaporates through the waterproof/moisture permeable sheets, humidifying the air.

While the invention has been shown and described herein above on the basis of certain preferred embodiments, these should not be construed as limiting, a wide variety of modifications and improvements being possible.

For example, an ultra-thin humidifier could be designed, by fabricating a humidifier element material comprising a thin panel frame configuration having an opening and having a waterproof/moisture permeable sheet affixed to the front side thereof so as to cover the opening, and a plurality of ribs arranged over the front face of the waterproof/moisture permeable sheet, extending between two opposite sides of the frame; affixing by adhesive or by fusion the humidifier element material to the wall of an air duct or flow passage for air to be humidified; and supplying humidifying water to the humidifier space defined by the wall and the humidifier element material.

The humidifier element, humidifier and humidifier unit herein can also be used as a dehumidifier/humidifier element, dehumidifier/humidifier and humidifier dehumidifier/humidifier unit, respectively.

For use as a dehumidifier/humidifier, element, dehumidifier/humidifier or dehumidifier/humidifier unit, the humidifier element, humidifier or humidifier unit herein may be supplied with a moisture absorbing/desorbing solution, as the liquid supplied to the humidifier elements. Moisture absorbing/desorbing solution refers to a solution that at low temperature absorbs moisture (water vapor) present in air, and that at higher temperature releases moisture as water vapor; materials known in the art may be used. Such materials include solutions containing as the solute water-soluble organic compounds such as diethylene glycol, triethylene glycol, glycerol etc.; or solutions containing water-soluble inorganic compounds such as lithium chloride, potassium chloride, sodium chloride, lithium bromide, phosphoric acid, sodium hydroxide, potassium hydroxide etc. The use of lithium chloride aqueous solution is especially preferred. The temperature at which the moisture absorbing/desorbing solution absorbs moisture is typically 10 to 35° C., preferably 20 to 30° C. The temperature at which the moisture absorbing/desorbing solution releases moisture as water vapor is higher than the temperature at which it absorbs moisture, typically 25 to 60° C., preferably 30 to 45° C.

Figure 11:
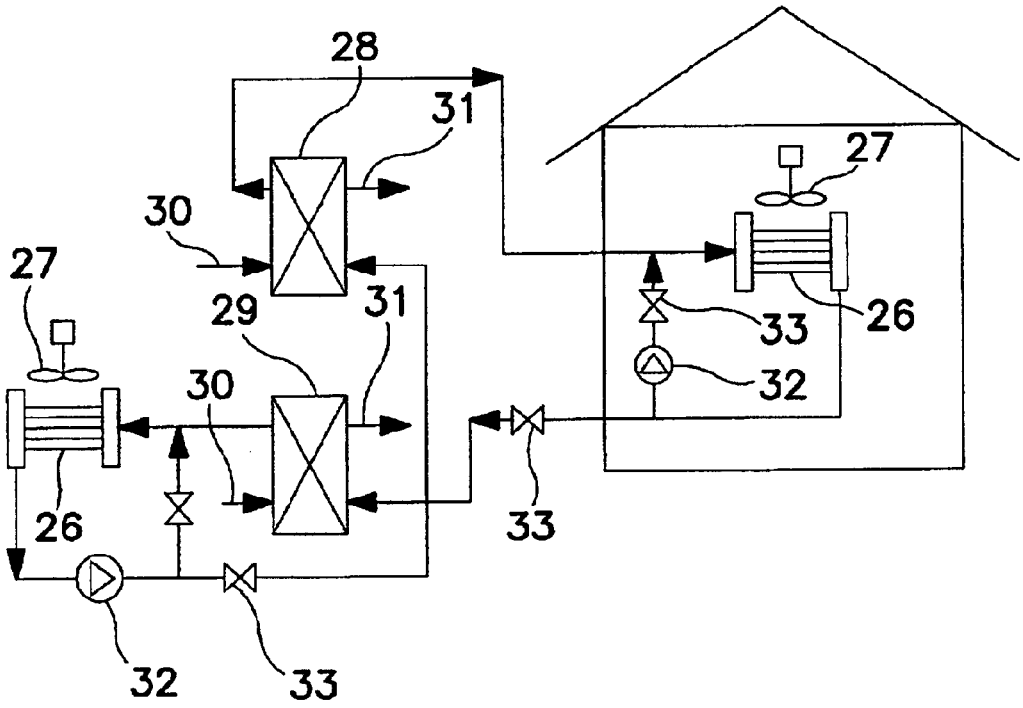
FIG. 11 is a diagram showing an exemplary arrangement for a dehumidifying system of the invention.

An exemplary arrangement for a dehumidifier/humidifier system is illustrated in FIG. 11. A dehumidifier/humidifier unit 26 is installed, together with a forced air fan 27, in a room to be humidity-conditioned. The moisture absorbing/desorbing solution is passed through a heat exchanger 28 where it is cooled to bring it to set temperature, and then enters the dehumidifier/humidifier unit 26, where it removes humidity from indoor air delivered by the forced air fan 27. The moisture absorbing/desorbing solution exiting the dehumidifier/humidifier unit 26 enters a return line, and in a diluted state (due to having absorbed moisture) enters a heat exchanger 29 where it is heated to bring it to set temperature, and then enters the outdoor dehumidifier/humidifier unit 26. In dehumidifier/humidifier unit 26 the moisture absorbing/desorbing solution is condensed by being induced to release moisture through humidification of outdoor air delivered by forced air fan 27. The condensed moisture absorbing/desorbing solution is returned to heat exchanger 28 by a liquid feed pump 32, cooled, and recirculated. Alternatively, moisture absorbing/desorbing solution supplied to dehumidifier/humidifier unit 26 may be circulated by means of a circulation regulator valve 33, to regulate the concentration and temperature of the moisture absorbing/desorbing solution. Where a dehumidifier/humidifier unit 26 installed indoors is used for humidification, the moisture absorbing/desorbing solution is passed through heat exchanger 28 where it is heated to bring it to set temperature, and then enters the dehumidifier/humidifier unit 26, where it humidifies indoor air delivered by the forced air fan 27. The moisture absorbing/desorbing solution exiting the dehumidifier/humidifier unit 26 enters a return line, and in a concentrate state (due to release of moisture) enters heat exchanger 29 where it is cooled to bring it to set temperature, and then enters the outdoor dehumidifier/humidifier unit 26. In dehumidifier/humidifier unit 26 the moisture absorbing/desorbing solution is diluted by being induced to dehumidify outdoor air delivered by forced air fan 27. The diluted moisture absorbing/desorbing solution is returned to heat exchanger 28 by a liquid feed pump, heated, and recirculated. Alternatively, moisture absorbing/desorbing solution supplied to dehumidifier/humidifier unit 26 may be circulated by means of a circulation regulator valve 33, to regulate the concentration and temperature of the moisture absorbing/desorbing solution.

Next is described an example of use of the gas/liquid separation element, gas/liquid separator and gas/liquid separation unit herein for degassing, i.e. separating gas from a process liquid.

Where the gas/liquid separation element, gas/liquid separator or gas/liquid separation unit herein is used for degassing, either the gas/liquid separator is installed in a hermetic housing, process liquid is flowed into the gas/liquid separation element, and the air flow channel (space formed between the gas/liquid separation element and the housing) of the gas/liquid separator is evacuated with a vacuum pump; or, in a manner exactly analogous to the humidifier system herein described earlier, process liquid (instead of humidification water) is flowed into the humidifier element and, instead of air, gas having a gas partial pressure of gas to be degassed lower than the process liquid is flowed into the air flow channel of the humidifier, to efficiently degas the process liquid. The degassing system can be used in a manner exactly analogous to the water supply system and humidifier system herein described earlier, but where a vacuum pump is used for degassing, a housing providing hermetic closure to the humidifier and a vacuum pump that can be connected to the housing to evacuate the housing will be needed.

Next is described an example of use of the gas/liquid separation element, gas/liquid separator and gas/liquid separation unit herein for gas dissolving, i.e. dissolving gas into a process liquid.

Where the gas/liquid separation element, gas/liquid separator or gas/liquid separation unit herein is used for gas dissolving, either the gas/liquid separator is installed in a hermetic housing, process liquid is flowed into to the gas/liquid separation element, and a gas for dissolving into the process liquid is flowed into the air flow channel (space formed between the gas/liquid separation element and the housing) of the gas/liquid separator; or, in a manner exactly analogous to the humidifier system herein described earlier, process liquid (instead of humidification water) is flowed into the humidifier element and, instead of air, gas to be dissolved is flowed into the air flow channel of the humidifier, to efficiently dissolve the gas into the process liquid. Where the gas being dissolved is corrosive or toxic, it is desirable to use the former method employing a hermetic housing, so that gas does not leak into the environment. The degassing system can be used in a manner exactly analogous to the water supply system and humidifier system herein described earlier, but where gas dissolving is carried out in a hermetic housing, a housing providing hermetic closure to the humidifier and a blower etc. that can be connected to the housing to supply gas into the housing will be needed.

By virtue of the arrangements described herein above, the invention provides the following extremely notable benefits.

(1) As the gas/liquid separation element houses no components for forming the liquid flow channel, e.g. spacers or fabric of three-dimensional construction, it resists clogging by foreign matter or impurities present in liquids, and has negligible liquid pressure loss.

(2) The ribs of the gas/liquid separation element are unified with the frame and waterproof/moisture permeable sheeting, preventing deformation of the waterproof/moisture permeable sheeting even when liquid pressure is high. Provision of ribs also increases the strength of the frame per se, allowing the frame to be thinner and the gas/liquid separator to be more compact. Where ribs are provided on the back face of the waterproof/moisture permeable sheeting (i.e. to the inside of the gas/liquid separation element), the strength of the frame can be increased to an even greater degree, allowing the frame to be even thinner and the gas/liquid separator to be even more compact.

(3) Since the gas flow channel is defined by ribs, contact area with the waterproof/moisture permeable sheeting is smaller than with conventional corrugated spacers, reducing loss of gas/liquid separation performance.

(4) The gas/liquid separator herein can be manufactured by stacking a plurality of gas/liquid separation elements and simultaneously adhering or fusing liquid inlet/outlet portions formed in their frames to a mounting frame, providing a simple, inexpensive manufacturing process.

(5) Where the waterproof/moisture permeable sheeting and frame in the gas/liquid separation element are fixed by means of injection molding, the process can be carried out in stable fashion, and connection with a liquid supply line or liquid outlet line can be effected by adhering or fusing the liquid inlet/outlet portion formed in the frame to mounting frame having a liquid inlet member or liquid outlet member, thus avoiding the difficult process of adhesion to the waterproof/moisture permeable sheeting, eliminating losses associated with adhesion.

(6) The gas/liquid separation element herein has a liquid inlet/outlet portion formed in a portion of its frame, so that when the gas/liquid separation element is tested for pressurized leakage, the liquid inlet/outlet portion can be connected to the pressurized liquid line of the leak tester, allowing gas/liquid elements to be tested individually.

EXAMPLES

Examples of the invention and comparisons are described below.

Example 1

Porous polytetrafluoroethylene film (approximately 30 μm thick, mean pore size approximately 0.2 μm, porosity 85%) was laminated on one face thereof with polyester nonwoven fabric (MARIKKUSU 903030WSO ex Unitika) using a heated roll, to produce waterproof/moisture permeable sheeting. The resultant waterproof/moisture permeable sheeting had moisture permeability of 20,000 $g/m^2 \cdot day$. Next, insert molding was carried out by cutting the waterproof/moisture permeable sheeting to 395×55 mm, setting it on the lower mold of the injecting mold assembly, with the nonwoven fabric face facing upward, and performing injection molding with resin to produce a 410×60×2.5 mm humidifier element material like that depicted in FIGS. 6 and 7. During the injection molding process the waterproof/moisture permeable sheet was secured in place with pins provided to the mold. Rib dimensions were 1.5 mm width, 1.0 mm height; 18 of these were arranged at 20 mm pitch. The molding unit was a Nisei Jushi Kogyo TH00-12VSE; conditions for injection molding were 30% injection speed, 75% injection pressure, 60° C. mold temperature, and 220° C. resin temperature. The resin was SAIKORAKKU X7-11001(N) from Ube Kosan.

Two of the resultant humidifier element materials were arranged back-to-back and bonded to produce a humidifier element like that depicted in FIGS. 1 to 5. The adhesive was KP1000 ex Konishi. 24 of the these humidifier elements were stacked to produce a 430×150×60 mm humidifier like that depicted in FIG. 8. The same Konishi adhesive was used to bond the humidifier elements to the mounting frame. The effective membrane surface area of the humidifier was 0.582 $m^2$; humidifier volume was 0.00324 $m^3$.

Example 2

Using waterproof/moisture permeable sheeting similar to that in Example 1, a humidifier was fabricated in the same manner as in Example 1, except for setting it on the lower mold of the injecting mold assembly, with the nonwoven fabric face facing downward. Effective membrane surface area was 0.582 $m^2$; humidifier volume was 0.00324 $m^3$.

Example 3

Using the same fabrication procedure as in Example 1, a humidifier was fabricated in the same manner as in Example 1, except for making the ribs 0.8 mm high. Effective membrane surface area was 0.582 $m^2$; humidifier volume was 0.00324 $m^3$, the same as in Example 1.

Comparison 1

Porous polytetrafluoroethylene film (approximately 30 μm thick, mean pore size approximately 0.2 μm, porosity 85%) was coated on one face thereof with polyurethane adhesive using a gravure roll (opening rate set to 80%), and onto this face was juxtaposed three-dimensional fabric (0.3 mm-diameter polyester monofilament knit, 1.5 mm thick) as a humidification water support layer, which was then roll compressed at 0.5 $kg/cm^2$ pressure, speed of 30 m/min. Three-dimensional fabric was then applied to the other face by the same method and under the same conditions, to produce a triple-layer film of compacted porous polymer film. The triple-layer film was cut to dimensions of 250×85 mm to produce a rectangular sheet. The perimeter of the rectangular sheet was thermally fused with a mold, and a hole 10 mm in diameter was produced at a location 18 mm from one short side of the sheet, at a point in the lateral center, to produce a water inlet to the film interior. Fifty-eight such samples were stacked and bonded to produce a humidifier. Effective membrane surface area of the humidifier was 1.74 $m^2$; humidifier volume was 0.00524 $m^3$.

Comparison 2

Using waterproof/moisture permeable sheeting similar to that in Example 1, a tubular membrane element 165 mm wide and 9.3 m in length, having the nonwoven fabric face of the waterproof/moisture permeable sheet facing outward, was fabricated. Bonding of the joined portion of the tubular membrane element was done with polyurethane adhesive. The resultant tubular membrane element and a vinyl chloride corrugated spacer 185 mm wide and 10 m in length were coiled in a coiled configuration and assembled in a mounting frame, providing an inlet for humidification water to one end of the tubular membrane element, to produce a humidifier. Effective membrane surface area of the humidifier was 3.069 $m^2$; humidifier volume was 0.0137 $m^3$.

Results of Comparison of Examples and Comparisons (1) Liquid Pressure Loss Comparison Tap water was brought down to pressure of 65 kPa, injecting water into the water inlet of the samples of Example 1 and Comparison 1 while monitoring flow rate with a flow meter. When full, the water supply was shut off. Water was then drained from the water inlet, measuring the time needed for 50% of the water to drain out. The sample of Example 1 had shorter drain time, indicating lower liquid pressure loss.

Example 1: 36 sec

Comparison 1: 112 sec (2) Comparison of Liquid Pressure Loss with Extended Operation The samples of Example 1 and Comparison 1 were supplied with air from a duct under conditions of a humidified flow rate of 250 $m^3$/h, 60° C., 40% RH environment, while supplying humidification water reduced from tap water pressure to 65 kPa with a pressure reduction valve. No water was drained from the humidifier during humidifier operation. After 200 hours of operation, operation was halted, the humidifier was detached from the duct, and the water was expelled from the humidifier.

Samples operated for 200 hours were then measured as described in (1). The Comparison sample showed clogging of the liquid flow channel. The sample of Example 1 was virtually unchanged from initial values, even after 200 hours of operation, and no clogging of the liquid flow channel was noted.

Example 1: 38 sec

Comparison 1: 156 sec (3) Humidification Performance (Volume/Surface Area Ratio)

Figure 12:
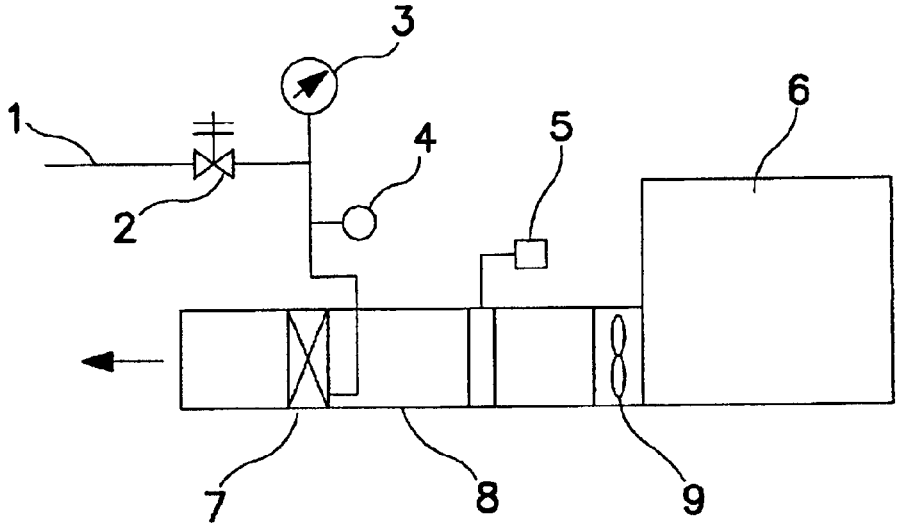
FIG. 12 is a diagram showing a humidification performance measuring unit used for evaluating performance of the humidifiers of the Examples and Comparisons.

The humidifiers of Examples 1, 2, 3 and Comparison 1 were set in the humidification performance measuring unit depicted in FIG. 12 to measure humidification volume, and supplied with air from a duct under conditions of a humidified flow rate of 250 $m^3$/h, 20° C., 40% RH environment, while supplying to the humidifier humidification water reduced from tap water pressure to 65 kPa with a pressure reduction valve. No water was drained from the humidifier during humidification volume measurement. The amount of tap water supplied to the humidifier was measured as humidification volume. Humidification volume was converted to a 1 $m^3$ humidifier volume basis and a 1 $m^2$ humidifier surface area basis for comparison. The humidifiers of Examples 1, 2 and 3 all showed higher humidification efficiency than the Comparison humidifiers.

The humidifier of Example 1 had the nonwoven fabric situated on the air system side, and the humidifier of Example 2 had the waterproof/moisture permeable membrane situated on the air system side. The humidifier of Example 2 showed higher humidification performance than the humidifier of Example 1. That is, it was found that humidification efficiency is higher when the waterproof/moisture permeable membrane is situated on the air system side.

The humidifier of Example 3 also showed higher humidification performance than the humidifier of Example 1. That is, it was found that humidification efficiency is higher when rib height is lower.

Example 1: 0.42 kg/hr, 130 kg/hr·$m^3$, 0.72 kg/hr·$m^2$
Example 2: 0.53 kg/hr, 164 kg/hr·$m^3$, 0.91 kg/hr·$m^2$
Example 3: 0.45 kg/hr, 139 kg/hr·$m^3$, 0.77 kg/hr·$m^2$
Comparison 1: 0.61 kg/hr, 116 kg/hr·$m^3$, 0.35 kg/hr·$m^2$
Comparison 2: 1.01 kg/hr, 74 kg/hr·$m^3$, 0.33 kg/hr·$m^2$ (4) Evaluation of Water Pressure which Humidifier Element Can Withstand (Water Pressure Resistance)

An air pressure reduction valve was attached to a water tank, and compressed air was supplied to pressurize the water tank, supplying the pressurized water to the humidifier elements of Example 1 and Comparison 1. Pressure ramp-up was 2 kPa/sec. For the humidifier element of Example 1, water pressure resistance was designated as the level of water pressure at which water began to exude from the surface of the waterproof/moisture permeable sheeting. For the humidifier element of Comparison 1, water pressure resistance was designated as the level of water pressure at which the polytetrafluoroethylene film and three-dimensional fabric delaminated. The humidifier element of Example 1 demonstrated higher water pressure resistance than the humidifier element of Comparison 1.

Example 1: 120 kpa
Comparison 1: 80 kPa

The above comparisons demonstrate the superiority of the humidifiers of Examples 1, 2 and 3.

While particular embodiments of the present invention have been illustrated and described herein, the present invention should not be limited to such illustrations and descriptions. It should be apparent that changes and modifications may be incorporated and embodied as part of the present invention within the scope of the following claims.

The invention claimed is:

1. A gas/liquid separation element comprising: a frame having front and back faces and at least two opposite sides and defining an opening therein; waterproof/moisture permeable sheets affixed to both faces of said frame so as to cover the opening, whereby said frame and said waterproof/moisture permeable sheets define a liquid flow channel; a plurality of ribs arranged over the front face of said waterproof/moisture permeable sheets, and extending between said two opposite sides of said frame; and a liquid inlet/outlet portion for liquid feed or liquid outlet, provided at one or more locations in a portion of said frame.

2. The gas/liquid separation element according to claim 1 wherein said frame comprises resin; and said waterproof/moisture permeable sheet is affixed simultaneously with molding of the frame by means of injection molding of the resin.

3. The gas/liquid separation element according to claim 1 wherein said ribs are formed simultaneously with molding of the frame by means of injection molding of the resin.

4. The gas/liquid separation element according to claim 1 wherein said waterproof/moisture permeable sheet and said ribs are bonded by fusing.

5. The gas/liquid separation element according to claim 1 wherein said waterproof/moisture permeable sheet is a laminate comprising protective sheeting and a waterproof/moisture permeable membrane.

6. The gas/liquid separation element according to claim 5 wherein said protective sheeting is arranged on the liquid flow channel side, and said waterproof/moisture permeable membrane is located on the opposite side thereof.

7. The gas/liquid separation element according to claim 5 wherein said protective sheeting comprises nonwoven fabric.

8. The gas/liquid separation element according to claim 5 wherein said waterproof/moisture permeable membrane comprises porous polymer film.

9. The gas/liquid separation element according to claim 8 wherein said porous polymer film is porous polytetrafluoroethylene film.

10. The gas/liquid separation element according to claim 9 wherein said porous polytetrafluoroethylene film matrix is coated with a water/oil repellent.

11. The gas/liquid separation element according to claim 9 wherein said porous polytetrafluoroethylene film is provided on at least one face thereof with a continuous film of hydrophilic resin.

12. The gas/liquid separation element according to claim 9 wherein said porous polytetrafluoroethylene film matrix is coated with a water/oil repellent.

13. A gas/liquid separation unit comprising a plurality of gas/liquid separators according to claim 12 arrayed with said liquid feed ports or outlet ports connected in liquid-tight fashion.

14. A humidifier with a stacked plurality of gas/liquid separation elements according to claim 1, wherein gas flow channels are formed between gas/liquid separation elements for the humidified gas, by means of said ribs arranged on the front face of said waterproof/moisture permeable sheet of each gas/liquid separation element, and wherein said liquid inlet/outlet portions are connected in liquid-tight fashion to form a common liquid feed port or liquid outlet port for humidifying water.

15. A dehumidifier/humidifier with a stacked plurality of gas/liquid separation elements according to claim 1, wherein gas flow channels are formed between gas/liquid separation elements for the dehumidified/humidified gas, by means of said ribs arranged on the front face of said waterproof/moisture permeable sheet of each gas/liquid separation element, and wherein said liquid inlet/outlet portions are connected in liquid-tight fashion to form a common liquid feed port or liquid outlet port for moisture absorbing/desorbing solution.

16. An air conditioner with a humidifier according to claim 14, wherein said humidifier is set inside an air duct that extends from the inlet to the outlet of the air conditioner.

17. A gas/liquid separation element comprising: a frame having front and back faces and defining an opening therein; waterproof/moisture permeable sheets affixed to both faces thereof so as to cover the opening, whereby said frame and said waterproof/moisture permeable sheets define a liquid flow channel; a plurality of ribs arranged over the front and back face of said waterproof/moisture permeable sheets, with said ribs arranged over said back face being partially cut away; and a liquid inlet/outlet portion for liquid feed or liquid outlet, provided at one or more locations in a portion of said frame.

18. The gas/liquid separation element according to claim 17 wherein said frame comprises resin; and said waterproof/moisture permeable sheet is affixed simultaneously with molding of the frame by means of injection molding of the resin.

19. The gas/liquid separation element according to claim 17 wherein said ribs are formed simultaneously with molding of the frame by means of injection molding of the resin.

20. The gas/liquid separation element according to claim 17 wherein said waterproof/moisture permeable sheet and said ribs are bonded by fusing.

21. The gas/liquid separation element according to claim 17 wherein said waterproof/moisture permeable sheet is a laminate comprising protective sheeting and a waterproof/moisture permeable membrane.

22. The gas/liquid separation element according to claim 21 wherein said protective sheeting is arranged on the liquid flow channel side, and said waterproof/moisture permeable membrane is located on the opposite side thereof.

23. The gas/liquid separation element according to claim 21 wherein said protective sheeting comprises nonwoven fabric.

24. The gas/liquid separation element according to claim 21 wherein said waterproof/moisture permeable membrane comprises porous polymer film.

25. The gas/liquid separation element according to claim 24 wherein said porous polymer film is porous polytetrafluoroethylene film.

26. The gas/liquid separation element according to claim 25 wherein said porous polytetrafluoroethylene film matrix is coated with a water/oil repellent.

27. The gas/liquid separation element according to claim 25 wherein said porous polytetrafluoroethylene film is provided on at least one face thereof with a continuous film of hydrophilic resin.

28. A gas/liquid separator comprising a stacked plurality of gas/liquid separation elements according to claim 17, wherein gas flow channels are formed between gas/liquid separation elements by means of said ribs arranged on the front face of said waterproof/moisture permeable sheet of each said gas/liquid separation element, and wherein said liquid inlet/outlet portions are connected in liquid-tight fashion to form a common liquid feed port or liquid outlet port.

29. A gas/liquid separation unit comprising a plurality of gas/liquid separators according to claim 28 arrayed with said liquid feed ports or outlet ports connected in liquid-tight fashion.

30. A humidifier with a stacked plurality of gas/liquid separation elements according to claim 17, wherein gas flow channels are formed between gas/liquid separation elements for the humidified gas, by means of said ribs arranged on the front face of said waterproof/moisture permeable sheet of each gas/liquid separation element, and wherein said liquid inlet/outlet portions are connected in liquid-tight fashion to form a common liquid feed port or liquid outlet port for humidifying water.

31. A dehumidifier/humidifier with a stacked plurality of gas/liquid separation elements according to claim 17, wherein gas flow channels are formed between gas/liquid separation elements for the dehumidified/humidified gas, by means of said ribs arranged on the front face of said waterproof/moisture permeable sheet of each gas/liquid separation element, and wherein said liquid inlet/outlet portions are connected in liquid-tight fashion to form a common liquid feed port or liquid outlet port for moisture absorbing/desorbing solution.

32. An air conditioner with a humidifier according to claim 30, wherein said humidifier is set inside an air duct that extends from the inlet to the outlet of the air conditioner.

33. A gas/liquid separation element comprising: two humidifier element materials, each said material comprising a frame having front and back faces and at least two opposite sides defining an opening therein; a waterproof/moisture permeable sheet affixed to the front face thereof so as to cover the opening, a plurality of ribs arranged over the front face of said waterproof/moisture permeable sheet, and extending between said two opposite sides of said frame, with said humidifier element materials being juxtaposed back face-to-back face and unified by bonding or fusing, and said frame and said waterproof/moisture permeable sheets defining a liquid flow channel; and a liquid inlet/outlet portion for liquid feed or liquid outlet, provided at one or more locations in a portion of said frame.

34. The gas/liquid separation element according to claim 33 wherein said frame comprises resin; and said waterproof/moisture permeable sheet is affixed simultaneously with molding of the frame by means of injection molding of the resin.

35. The gas/liquid separation element according to claim 33 wherein said ribs are formed simultaneously with molding of the frame by means of injection molding of the resin.

36. The gas/liquid separation element according to claim 33 wherein said waterproof/moisture permeable sheet and said ribs are bonded by fusing.

37. The gas/liquid separation element according to claim 33 wherein said waterproof/moisture permeable sheet is a laminate comprising protective sheeting and a waterproof/moisture permeable membrane.

38. The gas/liquid separation element according to claim 37 wherein said protective sheeting is arranged on the liquid flow channel side, and said waterproof/moisture permeable membrane is located on the opposite side thereof.

39. The gas/liquid separation element according to claim 37 wherein said protective sheeting comprises nonwoven fabric.

40. The gas/liquid separation element according to claim 37 wherein said waterproof/moisture permeable membrane comprises porous polymer film.

41. The gas/liquid separation element according to claim 40 wherein said porous polymer film is porous polytetrafluoroethylene film.

42. The gas/liquid separation element according to claim 41 wherein said porous polytetrafluoroethylene film matrix is coated with a water/oil repellent.

43. The gas/liquid separation element according to claim 41 wherein said porous polytetrafluoroethylene film is provided on at least one face thereof with a continuous film of hydrophilic resin.

44. A gas/liquid separator comprising a stacked plurality of gas/liquid separation elements according to claim 33, wherein gas flow channels are formed between gas/liquid separation elements by means of said ribs arranged on the front face of said waterproof/moisture permeable sheet of each said gas/liquid separation element, and wherein said liquid inlet/outlet portions are connected in liquid-tight fashion to form a common liquid feed port or liquid outlet port.

45. A gas/liquid separation unit comprising a plurality of gas/liquid separators according to claim 44 arrayed with said liquid feed ports or outlet ports connected in liquid-tight fashion.

46. A humidifier with a stacked plurality of gas/liquid separation elements according to claim 38 wherein gas flow channels are formed between gas/liquid separation elements for the humidified gas, by means of said ribs arranged on the front face of said waterproof/moisture permeable sheet of each gas/liquid separation element, and wherein said liquid inlet/outlet portions are connected in liquid-tight fashion to form a common liquid feed port or liquid outlet port for humidifying water.

47. A dehumidifier/humidifier with a stacked plurality of gas/liquid separation elements according to claim 39 wherein gas flow channels are formed between gas/liquid separation elements for the dehumidified/humidified gas, by means of said ribs arranged on the front face of said waterproof/moisture permeable sheet of each gas/liquid separation element, and wherein said liquid inlet/outlet portions are connected in liquid-tight fashion to form a common liquid feed port or liquid outlet port for moisture absorbing/desorbing solution.

48. An air conditioner with a humidifier according to claim 46, wherein said humidifier is set inside an air duct that extends from the inlet to the outlet of the air conditioner.

49. A gas/liquid separation element comprising: two humidifier element materials, each said material comprising a frame having front and back faces and at least two opposite sides defining an opening therein; a waterproof/moisture permeable sheet affixed to the front face thereof so as to cover the opening, a plurality of ribs arranged over the front and back faces of said waterproof/moisture permeable sheet, and extending between said two opposite sides of said frame, with said humidifier element materials being juxtaposed back face-to-back face and unified by bonding or fusing; said frame and said waterproof/moisture permeable sheets defining a liquid flow channel, and said ribs arranged over said back feces being partially cut away; and a liquid inlet/outlet portion for liquid teed or liquid outlet, provided at one or more locations in a portion of said frame.

50. The gas/liquid separation element according to claim 49 wherein said frame comprises resin; and said waterproof/moisture permeable sheet is affixed simultaneously with molding of the frame by means of injection molding of the resin.

51. The gas/liquid separation element according to claim 49 wherein said ribs are formed simultaneously with molding of the frame by means of injection molding of the resin.

52. The gas/liquid separation element according to claim 49 wherein said waterproof/moisture permeable sheet and said ribs are bonded by fusing.

53. The gas/liquid separation element according to claim 49 wherein said waterproof/moisture permeable sheet is a laminate comprising protective sheeting and a waterproof/moisture permeable membrane.

54. The gas/liquid separation element according to claim 53 wherein said protective sheeting is arranged on the liquid flow channel side, and said waterproof/moisture permeable membrane is located on the opposite side thereof.

55. The gas/liquid separation element according to claim 53 wherein said protective sheeting comprises nonwoven fabric.

56. The gas/liquid separation element according to claim 53 wherein said waterproof/moisture permeable membrane comprises porous polymer film.

57. The gas/liquid separation element according to claim 56 wherein said porous polymer film is porous polytetrafluoroethylene film.

58. The gas/liquid separation element according to claim 57 wherein said porous polytetrafluoroethylene film matrix is coated with a water/oil repellent.

59. The gas/liquid separation element according to claim 57 wherein said porous polytetrafluoroethylene film is provided on at least one face thereof with a continuous film of hydrophilic resin.

60. A gas/liquid separator comprising a stacked plurality of gas/liquid separation elements according to claim 49, wherein gas flow channels are formed between gas/liquid separation elements by means of said ribs arranged on the front face of said waterproof/moisture permeable sheet of each said gas/liquid separation element, and wherein said liquid inlet/outlet portions are connected in liquid-tight fashion to form a common liquid feed port or liquid outlet port.

61. A gas/liquid separation unit comprising a plurality of gas/liquid separators according to claim arrayed with said liquid feed ports or outlet ports connected in liquid-tight fashion.

62. A humidifier with a stacked plurality of gas/liquid separation elements according to claim 49, wherein gas flow channels are formed between gas/liquid separation elements for the humidified gas, by means of said ribs arranged on the front face of said waterproof/moisture permeable sheet of each gas/liquid separation element, and wherein said liquid inlet/outlet portions are connected in liquid-tight fashion to form a common liquid feed port or liquid outlet port for humidifying water.

63. A dehumidifier/humidifier with a stacked plurality of gas/liquid separation elements according to claim 49, wherein gas flow channels are formed between gas/liquid separation elements for the dehumidified/humidified gas, by means of said ribs arranged on the front face of said waterproof/moisture permeable sheet of each gas/liquid separation element, and wherein said liquid inlet/outlet portions are connected in liquid-tight fashion to form a common liquid feed port or liquid outlet port for moisture absorbing/desorbing solution.

64. An air conditioner with a humidifier according to claim 62, wherein said humidifier is set inside an air duct that extends from the inlet to the outlet of the air conditioner.

* * * * *

UNITED STATES PATENT AND TRADEMARK OFFICE

CERTIFICATE OF CORRECTION

PATENT NO. : 6,800,118 B2 
DATED : October 5, 2004
INVENTOR(S) : Ryo Kusunose, Takashi Yokota and Kojiro Nishl It is certified that error appears in the above-identified patent and that said Letters Patent is hereby corrected as shown below:

Column 19,
Lines 31-33, please delete claim 12, and replace with:
-- 12. A gas/liquid separator comprising a stacked plurality of gas/liquid separation elements according to claim 1, wherein gas flow channels are formed between gas/liquid separation elements by means of said ribs arranged on the front face of said waterproof/ moisture permeable sheet of gas/liquid separation element, and wherein said liquid inlet/ outlet portions are connected in liquid-tight fashion to form a common liquid feed port or liquid outlet port. --

Column 22,
Line 2, replace “38” with -- 33 --.
Line 11, replace “39” with -- 33 --.
Line 34, replace “feces” with -- faces --.
Line 35, replace “teed” with -- feed --.

Column 23,
Line 15, insert -- 60 -- after the word “claim”.

Signed and Sealed this

Twenty-second Day of February, 2005

JON W. DUDAS
*Director of the United States Patent and Trademark Office*